United States Patent [19]

Waldschmidt

[11] Patent Number: 4,716,275

[45] Date of Patent: Dec. 29, 1987

[54] EVAPORATOR COIL HEAT EXCHANGER ASSEMBLY

[75] Inventor: William L. Waldschmidt, Farmington, Minn.

[73] Assignee: Thermo King Corporation, Minneapolis, Minn.

[21] Appl. No.: 930,198

[22] Filed: Nov. 13, 1986

[51] Int. Cl.[4] ..... H05B 1/00

[52] U.S. Cl. ..... 219/201; 219/542; 338/315; 338/318

[58] Field of Search ..... 219/201, 542, 200; 338/277, 315, 318, 319, 320; 62/275, 276; 165/67

[56] References Cited

U.S. PATENT DOCUMENTS 1,621,424 3/1927 McGinnis ..... 219/201 X

*Primary Examiner*—E. A. Goldberg
*Assistant Examiner*—M. M. Lateef
*Attorney, Agent, or Firm*—D. R. Lackey

[57] ABSTRACT

An evaporator coil heat exchanger assembly of a refrigeration system, such as a transport refrigeration system, which includes an electrical heating element for rapid defrosting of the evaporator coil with its attendant refrigerant carrying tubes and cooling fins. The electrical heating element is quickly attached to the collective edges of the cooling fins by a plurality of low cost spring retainer clips which have one portion which extends between two closely spaced cooling fins to hook a refrigerant carrying tube, and another portion which holds the heating element against edges of the cooling fins with a spring force. The spring retainer clips may be just as quickly removed should the heating element require replacement. Only three curved sections are required to be formed in a single length of wire to form the active elements of the spring retainer clip, and a handle portion is formed in the remaining portion of the single wire length.

6 Claims, 4 Drawing Figures

EVAPORATOR COIL HEAT EXCHANGER ASSEMBLY

BACKGROUND OF THE INVENTION

1. Field of the Invention

The invention relates in general to refrigeration systems, and more specifically to refrigeration systems having electrical heaters for defrosting the evaporator coil heat exchanger assembly.

2. Description of the Prior Art

In refrigeration systems, such as transport refrigeration systems for conditioning the air of a truck or trailer hauling fresh or frozen loads, it is common to rapidly defrost the evaporator heat exchanger assembly with electrical heaters when the frost and ice build-up reduces the effectiveness of air flow over the evaporator. The evaporator section of the refrigeration system includes a plurality of refrigerant carrying tubes, often called hairpin tubes, with a large number of thin, closely spaced metallic heat exchanger plates or fins connected to the coolant tubes. The fins are usually wavy or corrugated to increase the surface area for a given heat exchanger volume. Frost builds up on the fins and impedes air flow over the surface of the fins, and it is this frost that must be periodically removed.

U.S. Pat. No. 3,786,227, which is assigned to the same assignee as the present application discloses periodically replacing spaced groups of fins across the heat exchanger assembly with relatively thick metallic plates, each of which has an electrical heating element attached thereto. While this is highly effective, it requires modification of the heat exchanger unit at the time of manufacture, and adds significantly to the manufacturing cost.

Another prior art approach holds an electrical heating element against the edges of the fins with a plurality of spaced metallic channel members, each of which extends across the two legs of a U-shaped electrical heating element. Each channel member includes two spring loaded fasteners, with each spring loaded fastener including a hook, a helical spring, and two large washers. While this approach does not require modification of the heat exchanger at the time of manufacture, the channel shaped device is relatively costly to manufacture and is awkward for one assembler to install. In a transport refrigeration system the evaporator heat exchanger is elevated, requiring an installer to work from below the unit. The heating element must be held against the edges of the fins which make up the lower surface of the heat exchanger, the metallic channel must be placed over the two legs of a heating element, and the two spring loaded fasteners must each be threaded up between two closely spaced wavy heat exchanger fins and attached to a coolant tube. The channel must usually be moved or adjusted along the heating element after the initial placement, until the fasteners are properly aligned with a coolant tube.

Thus, it is an object of the present invention to provide new and improved arrangement for disposing electrical heating elements in heat conducting relation with the fins of an evaporator heat exchanger assembly of a transport refrigeration system. The new and improved arrangement should not require modification of the heat exchanger assembly, it should have a lower manufacturing cost than prior art arrangements, and it should make it easier and quicker for a single installer to initially install and to replace electrical heating elements in heat exchange relation with the fins of an evaporator heat exchanger assembly.

SUMMARY OF THE INVENTION

Briefly, the present invention is a new and improved evaporator coil heat exchanger assembly which includes an electrical heating element for quickly defrosting the heat exchanger fins of the assembly. The electrical heating element is quickly and easily attached to the fins of the heat exchanger assembly by spring retainer clips which require a single hand to install, freeing the other hand of the installer for initially holding the heating element in heat exchange relation with the heat exchanger fins. Each spring retainer clip is a single piece of wire having first and second ends, with the wire having at least first, second, and third curved sections which proceed in the recited order from the first end towards the second end of the wire. The curved sections are all disposed in a common plane to enable the retainer clip to be easily inserted between two adjacent heat exchanger fins, even when the fins are of the wavy type. The first and second curved sections are respectively disposed about a coolant tube and about the heating element, with the spacing between the first and second curved sections being selected such that a spring force is developed which firmly holds the heating element against the heat exchanger fins. A curved handle is formed adjacent the second end of the wire which enables the retainer clip to be easily held as the first end is inserted between two heat exchanger fins and the first curved section is hooked over a coolant tube. The handle further enables the second curved section of the retainer clip to be pulled downwardly after the first curved section has been hooked to a coolant tube to allow the second curved section to be snapped over the heating element, to hold the heating element tightly against the heat exchanger fins.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
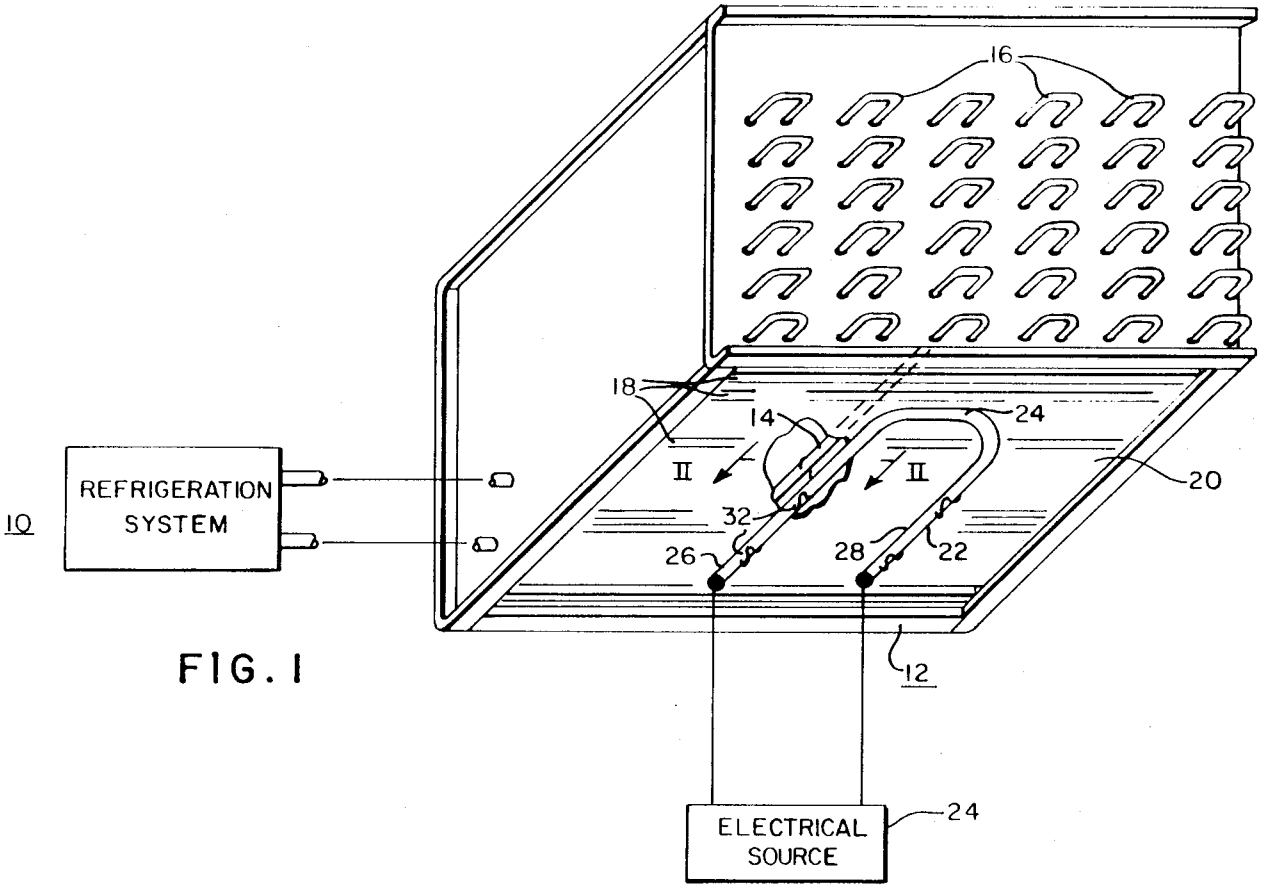
FIG. 1 is a perspective view of an evaporator coil heat exchanger assembly constructed according to the teachings of the invention.

Referring now to the drawings, and to FIG. 1 in particular, there is shown a refrigeration system 10 which may be a transport refrigeration system such as shown in U.S. Pat. No. 4,394,818. This patent, which is assigned to the same assignee as the present application, is hereby incorporated into the specification of the present application by reference. Refrigeration system 10 includes an evaporator coil heat exchanger assembly 12 having a plurality of refrigerant carrying tubes 14, such as hairpin tubes, the ends 16 of which are visible at one end of the assembly 12. The tubes 14 are in thermal flow communication with a plurality of closely spaced metallic cooling fins 18, which are typically spaced about 5 mm apart. The closely spaced fines 18 collectively define a bottom surface 20 of the assembly 12.

In order to provide a supply of heat for rapid defrosting of the fins 18, one or more electric heating elements are held in contact with the bottom surface 20 of assembly 12, such as electric heating element 22. As illustrated, heating element 22 is electrically connected to a source 24 of electrical potential, such as an alternator which is part of the refrigeration system 10. Heating element 22 is in the form of a wire, such as a Calrod heating element, and it may have any desired configuration, such as the U-shaped configuration illustrated which includes a bight 25 and leg portions 26 and 28.

Figure 2:
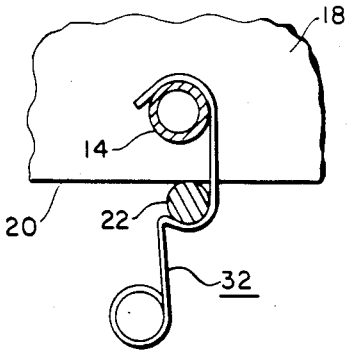
FIG. 2 is a cross sectional view of the evaporator coil heat exchanger assembly shown in FIG. 1, taken between and in the direction of arrows II—II.

According to the teachings of the invention, heating element 22 is held firmly against bottom surface 20 defined by the closely spaced fins 18 by a plurality of spring retainer clips or clamps 32. FIG. 2 is a cross sectional view of a spring retainer clip 32 taken between and in the direction of arrows II—II in FIG. 1. Spring retainer clip 32 is formed from a single piece of metallic wire selected for its ability to withstand the surface temperature of the heating element 22, which may be about 400 degrees C., for example. Stainless steel wire, such as a 406 stainless, having a diameter of about 0.1 cm has been found to be suitable.

Figure 3:
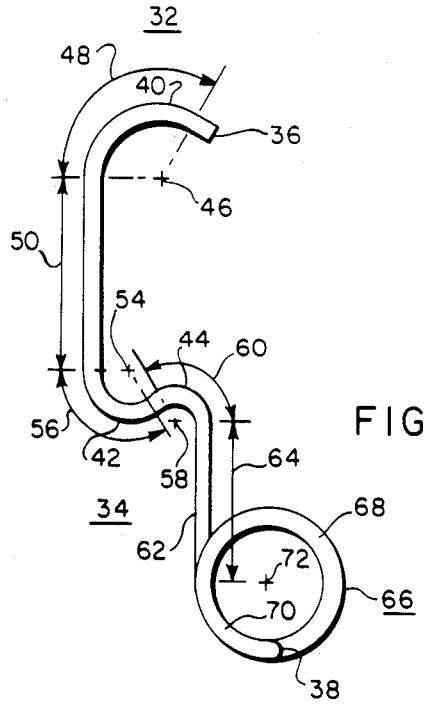
FIG. 3 is an enlarged elevational view of a spring retainer clip constructed according to the teachings of the invention.
Figure 4:
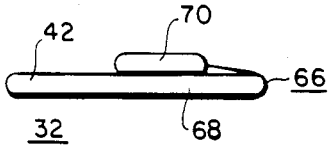
FIG. 4 is an end view of the spring retainer clip shown in FIG. 3.

FIG. 3 is an enlarged elevational view of spring retainer clip 32, and FIG. 4 is an end view of the clip 32 shown in FIG. 3. Spring retainer clip 32 is constructed of a single length of wire 34 having first and second ends 36 and 38, respectively. Spring retainer clip 32 has at least first, second and third curved sections 40, 42, and 44, respectively, which start adjacent to the first end 36 and proceed in the recited order towards the second end 38. As shown in FIG. 4, the three sections 40, 42 and 44 all lie in a common plane, so that the spring retainer clip 32 may be easily inserted between two of the closely adjacent cooling fins 18. The first curved section 40 starts close to end 36 and extends for an arc of about 120 degrees, about a center 48, with the 120 degree arc being indicated by double headed arrow 48. The radius of curved portion 40 is selected according to the diameter of the coolant tube 14 it will be "hooked" over, with a radius of about 5 mm being suitable for a coolant tube having a diameter of about 10 mm, for example.

The second curved section 42 is spaced from the first curved section 40 by a length 50 of wire having a dimension indicated by double headed arrow 52. The second curved section 42 has a center 54 which is located on the same side of the length 50 as the center 46, and it extends for an arc of about 120 degrees, as indicated by double headed arrow 56. The radius of the second curved section is selected according to the diameter of the heating element 22 it will be associated with, with a radius of about 2.3 to 2.5 mm being suitable for a heating element 22 having a diameter of about 6 to 7 mm. Thus, the concave sides of the first and second curved sections 40 and 42 face one another.

The third curved section 44 follows the second curved section 42 almost immediately, with very little straight portion therebetween. The third curved portion 44 has a center 58 which is on the opposite side of wire 34 from centers 46 and 54, and it extends for an arc of about 120 degrees, as indicated by double headed arrow 60. The radius of the third curved section 44 is selected to provide a "knee" sufficient to hold the heating element 22, with a radius of about 1.5 mm being suitable for use with the radii previously given as examples for the first and second curved sections 40 and 42.

The third curved section 44 terminates at the start of a straight length 62 having a dimension indicated by double headed arrow 64. A curved handle portion 66 is formed between the end of the straight length 62 and the second end 38 of the wire 34, with handle portion 66 having overlapping first and second curved portions 68 and 70 to increase the finger gripping surface and width of the handle portion 66. For example, the first curved portion 68 may form a complete circle having a center 72, while the overlapped second portion 70 may be a portion of a circle having the same center 72. Since more than one size of spring retainer clip 32 will be necessary to accommodate the complete range of different refrigeration system ratings, such as three, for example, the radius of the curved portions 68 and 70 of the handle portion 66 may be selected to be visibly different on each of the different spring retainer clip sizes, for easy identification.

The dimension between centers 46 and 54, which is the same dimension as the straight length 50, is selected such that the first curved section 40 may be inserted between two cooling fins 18 and hook over a coolant bue 14, while requiring the handle 66 to be pulled downwardly after hooking the coolant tube 14 to spring open the clip 32 and capture the heating element 22. The downward pulling force on handle portion 66 springs open or increases the dimension between the knee formed by the third curved section 44 and the concave side of the first curved section 40, to enable the spring retainer clip 32 to snap over the heating element 22 and tightly hold the heating element 22 against the bottom surface 20 defined by the edges of the cooling fins 18, as the pulling force on the handle portion 66 is released. A plurality of spring retainer clips 32 may thus be quickly snapped over the heating element 22, to hold it in the desired position, and the clips 32 may just as quickly be removed should the heating element 22 require replacement. A typical number of spring retainer clips 32 required to hold a U-shaped heating element is eight, compared with three channel type clamping arrangements of the prior art, with the total cost of eight spring retainer clips constructed according to the invention being only about one-fourth the total cost of three prior art channel type clamping arrangements, which, in addition to an elongated metallic channel, requires two hooks, two helical springs, and two large washers, for each clamping assembly.

I claim as my invention:

1. An elevator coil heat exchanger assembly comprising:

a plurality of refrigerant carrying tubes, a plurality of cooling fins disposed in heat conducting relation with said tubes, said cooling fins being disposed in spaced relation with a predetermined spacing, a heating element for defrosting the evaporator coil section, and a plurality of spring retainer clips disposed to hold said heating element against the cooling fins, each of said spring retainer clips being a single piece of wire having first and second ends, and at least first, second, and third curved sections which proceed in the recited order from the first end towards the second end, said first, second and third curved sections each having a concave side, with the concave sides of the first and second curved sections facing one another, and with the concave side of the third curved section facing the second end of the wire, said first, second, and third curved sections being disposed in a common plane, to enable the associated portions of the spring retainer clip to fit in the predetermined spacing between ajdacent cooling fins, said first and second curved sections being respectively disposed about a tube of said evaporator section and about said heating element, said first and second curved sections being spaced by a predetermined dimension selected to cause a spring retainer clip to exert a force against the heating element, to hold the heating element against the cooling fins.

2. The assembly of claim 1 wherein the first, second, and third curved sections are circular, and each include a curved arc of about 120 degrees.

3. The assembly of claim 1 wherein the third curved section immediately follows the second curved section, with substantially no spacing between the end of the second curved section and the start of the third curved section.

4. The assembly of claim 1 wherein the first and section curved sections are spaced by a straight section of the wire.

5. The assembly of claim 1 including a handle portion which starts at the second end, and which is spaced from the third curved section.

6. The assembly of claim 5 wherein the handle portion includes at least two superposed layers of wire to increase the thickness of the handle portion over that of the wire itself.

* * * * *